US006843235B2

(12) United States Patent
Mashimo et al.

(10) Patent No.: US 6,843,235 B2
(45) Date of Patent: Jan. 18, 2005

(54) FUEL SUPPLY UNIT

(75) Inventors: Toru Mashimo, Gunma (JP); Hajime Hosoya, Gunma (JP); Hiroshi Okada, Gunma (JP); Masato Kumagai, Saitama (JP)

(73) Assignee: Hitachi Unisia Automotive, Ltd., Kanagawa (JP)

( * ) Notice: Subject to any disclaimer, the term of this patent is extended or adjusted under 35 U.S.C. 154(b) by 0 days.

(21) Appl. No.: 10/706,041

(22) Filed: Nov. 13, 2003

(65) Prior Publication Data

US 2004/0109773 A1 Jun. 10, 2004

(30) Foreign Application Priority Data

Dec. 6, 2002 (JP) ..... 2002-355335

(51) Int. Cl.[7] ..... F02M 37/04

(52) U.S. Cl. ..... 123/509; 123/198 D; 137/565.17

(58) Field of Search ..... 123/509, 514, 123/495, 198 D; 137/565.16, 565.17, 565.34, 572

(56) References Cited

U.S. PATENT DOCUMENTS 4,205,648 A * 6/1980 Graham ..... 123/497
5,435,691 A * 7/1995 Braun et al. ..... 415/55.6
5,782,223 A 7/1998 Yamashita et al.
6,216,734 B1 * 4/2001 Umetsu et al. ..... 137/565.24
6,539,926 B2 * 4/2003 Hakansson et al. ..... 123/495
6,675,778 B1 * 1/2004 Kemper et al. ..... 123/516
6,679,229 B2 * 1/2004 Wada et al. ..... 123/516
6,729,307 B2 * 5/2004 Dong ..... 123/509

FOREIGN PATENT DOCUMENTS

JP 3256972 B2 12/2001

* cited by examiner

*Primary Examiner*—Carl S. Miller
(74) *Attorney, Agent, or Firm*—Sughrue Mion, PLLC

(57) ABSTRACT

A fuel supply unit, includes:

1) a fuel pump including;
   i) a motor section, and
   ii) a pump section driven by the motor section, the pump section pumping a fuel; and
2) a fuel tank provided with;
   i) a including;
      a) an inner section for housing therein one of the following:
         α) the motor section, and
         β) a first part of the motor section,
      b) an outer section provided with one of the following:
         α) the pump section, with the motor section housed in the inner section, and
         β) the pump section and a second part of the motor section, with the first part of the motor section housed in the inner section.

The inner section of the motor housing bulkhead is substantially sealably separated from the outer section of the motor housing bulkhead, in such a manner as to bring about an oil tightness.

28 Claims, 12 Drawing Sheets

FUEL SUPPLY UNIT

BACKGROUND OF THE INVENTION

1. Field of the Invention

The present invention relates to a fuel supply unit for supplying a fuel (in a tank), for example, to an engine and the like of a vehicle.

2. Description of the Related Art

In general, a fuel supply unit of an engine and the like of a vehicle is, on the whole, constituted of a fuel tank for tanking therein a fuel, a cover member mounted to the fuel tank, and a fuel pump disposed substantially below the fuel tank and supplying the fuel {in the fuel tank} to an injection valve and the like on an engine body's side.

The fuel pump is, on the whole, constituted of:

- a pump case extending substantially upward and downward;
- a motor section disposed on an upside of the pump case and including a stator, a rotor, a brush and the like; and
- a pump section which is driven by means of the motor section, sucks a fuel in the fuel tank and discharges the thus sucked fuel outside the fuel tank.

The pump section is formed with an intake port for taking therein the fuel in the fuel tank, while the pump case has an upper section formed with a discharge port for discharging the fuel.

U.S. Pat. No. 5,782,223 (equivalent of Japanese Patent No. 3256972 or JP3256972B2) discloses a fuel supply unit (referred to as "FUEL SUPPLY SYSTEM"). Driving a pump section by means of a motor section of a fuel pump may intake a fuel from an intake port into the pump section. Then, the pump section may discharge the fuel to the motor section's side. With the above constitution and operation, the fuel is discharged from a discharge port to an injection valve of an engine body's side after passing through a gap (between a stator and a rotor), a periphery of a brush and the like in the motor section.

According to U.S. Pat. No. 5,782,223 (equivalent of Japanese Patent No. 3256972 or JP3256972B2), however, the fuel is delivered from the pump section, through the gap, the periphery of the brush and the like of the motor section, to the engine body's side, thus mixing dust, melt and the like (which may have been caused by wear powder and the like of the brush of the motor section) into the fuel. Thereby, removing the wear powder and the like is expected to be in need for enhanced capacity and performance of a fuel filter, resulting in greater dimension, increased cost and the like of the fuel filter.

Preventing the motor section from corrosion or melt which may be caused by the fuel may be in need for a material with oil-proof. Moreover, preventing the mixture of the wear powder into the fuel may be in need for a material that is unlikely to cause the wear powder to the motor section. This may lead to an increased cost of the material for the motor section, resulting in increased production cost.

The fuel passing through the motor section may become a resistance against rotation of the rotor. In view of a possible loss caused by the resistance, the motor section may be in need for having an increased output, resulting in increased cost in this respect.

Moreover, the fuel passing thought the motor section may cause a heat that may be responsible for an increased temperature of the fuel, causing vapor and the like.

BRIEF SUMMARY OF THE INVENTION

It is an object of the present invention to provide a fuel supply unit for supplying a fuel (in a tank), for example, to an engine and the like of a vehicle.

More specifically, the above fuel supply unit is one that has a motor section or at least a part of the motor section separated from a fuel. With the above constitution, the motor section can be free from any influence (sulfurization and the like) which may be caused by the fuel and can prevent mixture of wear powder and the like (which may be caused by operation of a motor section) into the fuel, resulting in improved reliability and decreased production cost using low-priced material for the motor section.

According to an aspect of the present invention, there is provided a fuel supply unit, comprising:

1) a fuel pump comprising;

i) a motor section, and ii) a pump section driven by the motor section, the pump section pumping a fuel; and 2) a fuel tank for tanking therein the fuel to be pumped by the pump section and to be discharged out of the fuel tank by the pump section, the fuel tank being provided with;

i) a motor housing bulkhead sunk into the fuel tank, the motor housing bulkhead comprising;

a) an inner section for housing therein one of the following:

α) the motor section, and

β) a first part of the motor section, b) an outer section provided with one of the following:

α) the pump section, with the motor section housed in the inner section, and

β) the pump section and a second part of the motor section, with the first part of the motor section housed in the inner section.

The inner section of the motor housing bulkhead is substantially sealably separated from the outer section of the motor housing bulkhead, in such a manner as to bring about an oil tightness.

The other object(s) and feature(s) of the present invention will become understood from the following description with reference to the accompanying drawings.

DETAILED DESCRIPTION OF THE EMBODIMENT

In the following, various embodiments of the present invention will be described in detail with reference to the accompanying drawings.

For ease of understanding, the following description will contain various directional terms, such as, left, right, upper, lower, forward, rearward and the like. However, such terms are to be understood with respect to only a drawing or drawings on which the corresponding part of element is illustrated.

<First Embodiment—Constitution>

FIG. 1 to FIG. 7 show a fuel supply unit applied to an engine of a vehicle, according to a first embodiment of the present invention.

There is provided a fuel tank 1 installed on the vehicle and the like. Fuel tank 1 shaped substantially into a box can tank therein a fuel. Fuel tank 1 includes a cover body 21 (to be described afterward). Fuel tank 1 has a lower plate 1A and an upper plate 1B. Upper plate 1B is formed with a mount opening 2 having a wall for mounting cover body 21.

Figure 2:
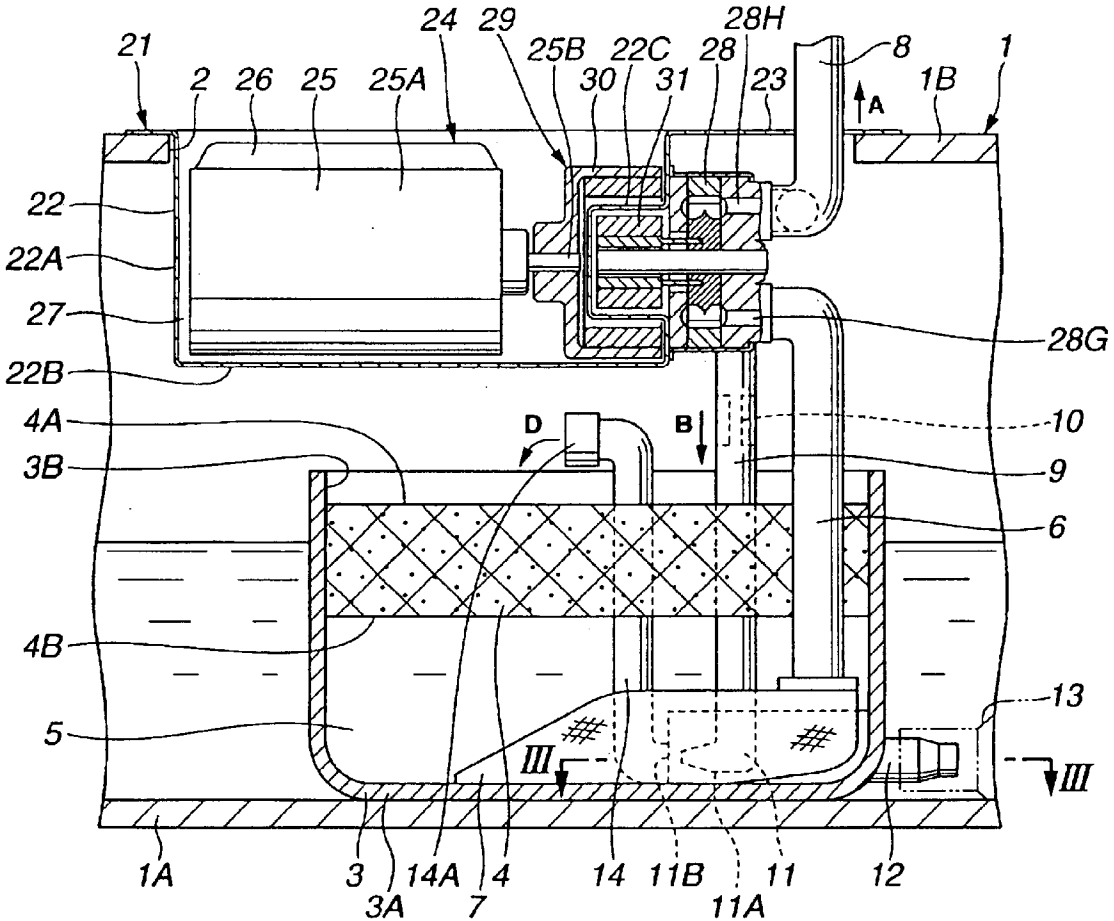
FIG. 2 shows an enlarged view of a longitudinal cross section of the fuel supply unit in FIG. 1, according to the first embodiment.

There is provided a chamber 3 disposed in fuel tank 1. Chamber 3 is, as is seen in FIG. 2, shaped substantially into a based barrel. A lower side of chamber 3 is formed with a base section 3A which is blocked, while an upper side of chamber 3 is formed with an open section 3B. Chamber 3 is disposed in fuel tank 1, with base section 3A abutting on the lower plate 1A of fuel tank 1. A part of the fuel in fuel tank 1 is allowed to flow in chamber 3 by way of a fuel filter 4 (to be described afterward).

Chamber 3 continuously can chamber therein the part of the fuel in fuel tank 1. Around an end (lower in FIG. 2) of a suck pipe 6 (to be described afterward), namely, an inner intake filter 7 (to be described afterward), chamber 3 may chamber therein a certain amount of the fuel. With this, even in the following exemplary states, around inner intake filter 7 chamber 3 can sufficiently secure the fuel which is taken in through an intake port 28G (to be described afterward) of a fuel pump 24 (to be described afterward):

State 1. Remnant of the fuel in fuel tank 1 gets short, lowering fuel level.

State 2. The fuel level in fuel tank 1 is inclined due to a pivotal travel and the like of the vehicle.

There is provided a fuel filter 4 mating with a wall on open section 3B's side of chamber 3. Fuel filter 4 is a mesh made of a fiber, a sponge made of porous material, or the like. Fuel filter 4 is a filter element shaped substantially into a plate having an upper face 4A and a lower face 4B. In fuel tank 1, fuel filter 4 covers open section 3B in such a manner as to separate a space outside chamber 3 from a space inside chamber 3, thus forming a fuel reservoir 5 (a partitioned area) in chamber 3.

Upper face 4A's side of fuel filter 4 acts as an intake port (facing the space in fuel tank 1) for the fuel to flow in, while the lower face 4B's side of fuel filter 4 acts an outflow port (facing fuel reservoir 5) for the fuel to flow out into-fuel reservoir 5. With the above constitution of fuel filter 4, the fuel in fuel tank 1 flowing into fuel reservoir 5 can be filtered through fuel filter 4.

Figure 4:
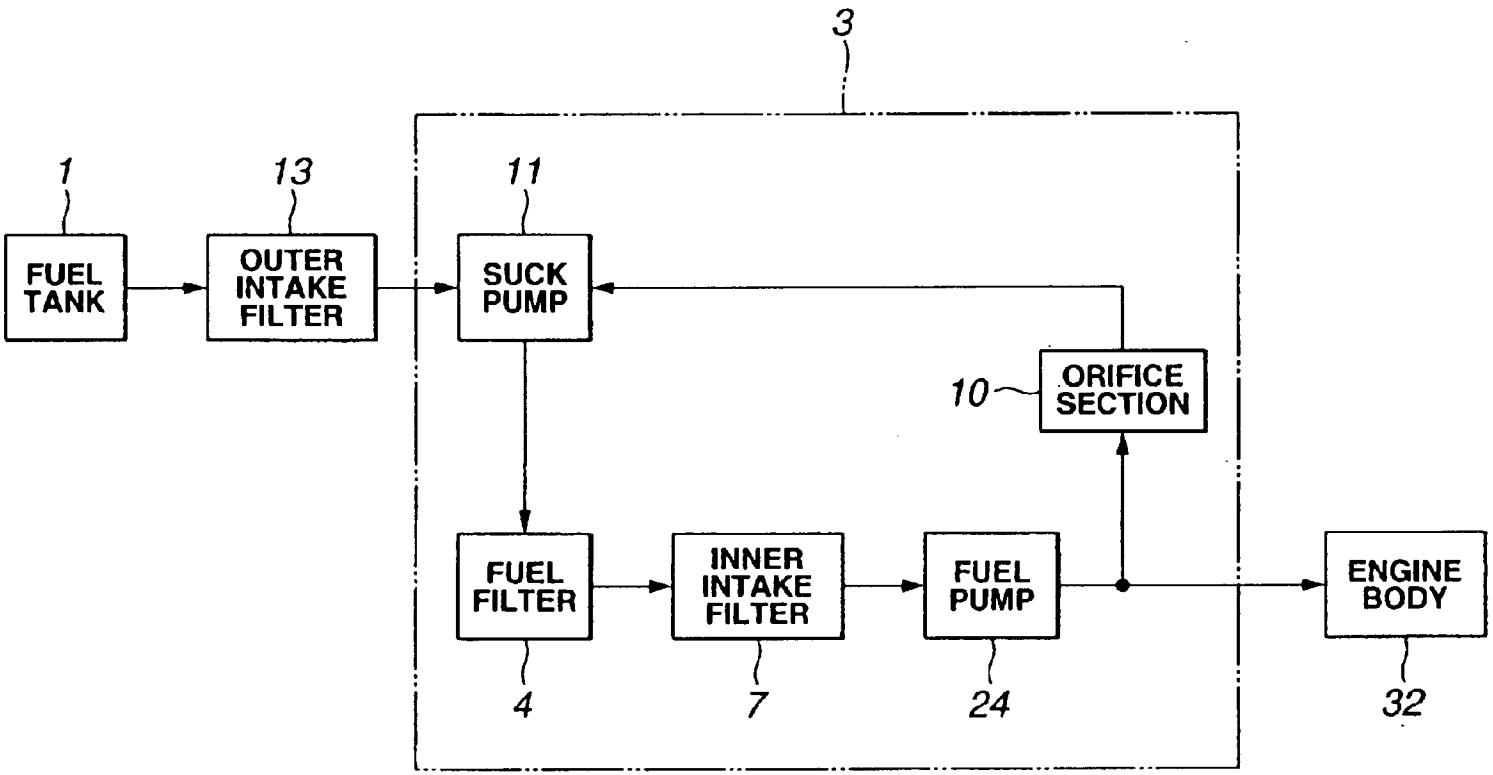
FIG. 4 shows a schematic diagram of a fuel supply flow by means of the fuel supply unit, according to the first embodiment.

In this case, as is seen in FIG. 4, fuel pump 24 can intake and discharge the fuel filtered through fuel filter 4. Herein, with respect to fuel flow to an engine body 32 (to be described afterward)'s side, namely, an injection valve 35 (to be described afterward)'s side, fuel filter 4 is disposed on an upstream (lower in FIG. 2, namely, on an intake port 28G's side) of fuel pump 24.

There is provided suck pipe 6 for sucking the fuel in fuel tank 1 to a pump section 28 (to be described afterward) of fuel pump 24. Suck pipe 6 has a base end side (upper in FIG. 2) connected to intake port 28G of pump section 28. Suck pipe 6 has a head end side (lower in FIG. 2) extending downward through fuel filter 4. A head end (of suck pipe 6) disposed on a base of fuel reservoir 5 is fitted with inner intake filter 7.

There is provided a fuel supply pipe 8 for supplying outward the fuel in fuel tank 1, as is seen in FIG. 2. Fuel supply pipe 8 has a base end side (lower in FIG. 2) connected to a discharge port 28H (to be described afterward) of pump section 28. Fuel supply pipe 8 has a head end side (upper in FIG. 2) protruding out of fuel tank 1 by way of a flange section 23 (to be described afterward) of cover body 21, and connecting to injection valve 35 by way of a first pipe 33 (to be described afterward), a second pipe 34 (to be described afterward) and the like in FIG. 1.

There is provided a pipe 9 for a suck pump 11 (to be described afterward). Pipe 9 supplies to suck pump 1 the part of the fuel pumped by fuel pump 24. Pipe 9 has a base end side (upper in FIG. 2) connected to a way of the supply pipe 8. The pipe has a head end side (lower in FIG. 2) extending downward through fuel filter 4 and connecting to a nozzle section 11A (to be described afterward) of suck pump 11. Moreover, a way of pipe 9 is formed with an orifice section 10 (to be described afterward) for dividing the fuel from fuel pump 24 into one supplied to suck pump 11's side and the other supplied to injection valve 35's side.

There is provided suck pump 11 which is a jet pump and the like disposed in chamber 3. Suck pump 11 uses the part of the fuel pumped by fuel pump 24, so as to help convey the fuel from outside chamber 3 to upper face 4A's side of fuel filter 4.

Figure 3:
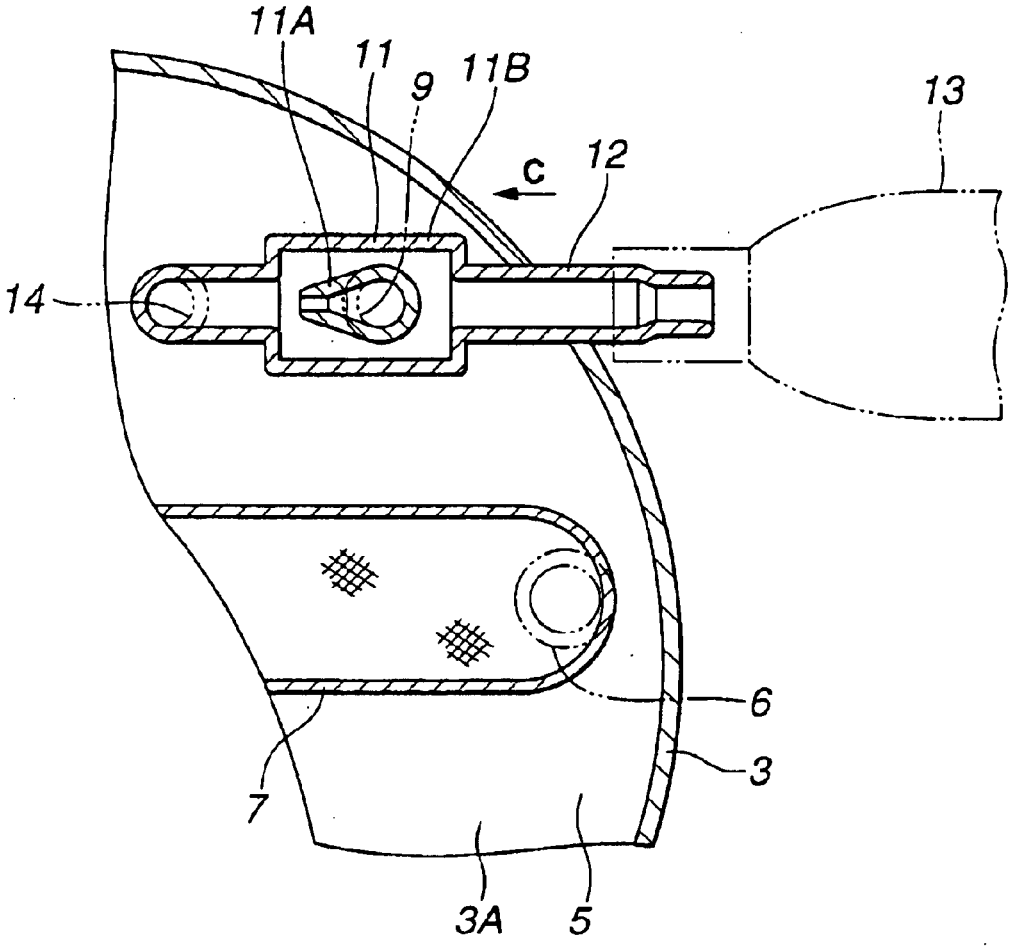
FIG. 3 shows a partly enlarge cross section of suck pump 11 and the like taken along lines III—III in FIG. 2, according to the first embodiment.

Herein, suck pump 11 is, as is seen in FIG. 3, has a base end side (right in FIG. 3) connected to pipe 9 and a head end side (left in FIG. 3). The head end side (left in FIG. 3) of suck pump 11 is formed with: nozzle section 11A having a reduced diameter, and a suck section 11B surrounding nozzle section 11A. Suck section 11B has a base end section (right in FIG. 3) connected to a suck pipe 12 (to be described afterward) and a head end side (left in FIG. 3) connected to a discharge pipe 14 (to be described afterward).

With the part of the fuel pumped by fuel pump 24 flown into nozzle section 11A by way of pipe 9, suck pump 11 may allow the fuel to flow out of the head end side of nozzle section 11A at a high flow rate, thus causing a negative pressure in suck section 11B. With the above operation, suck pump 11 can suck the fuel from outside chamber 3 by way of suck pipe 12. Then, suck pump 11 can help discharge the thus sucked fuel to discharge pipe 14, together with the fuel from nozzle section 11A.

There is provided suck pipe 12 for sucking, by means of suck pump 11, the fuel from outside chamber 3. Suck pipe 12 has a base end side (left in FIG. 2) connected to suck section 11B of suck pump 11, and a head end side (right in FIG. 2) protruding outward on base section 3A's side of chamber 3. An outer intake filter 13 for preventing entry of a foreign matter into suck pump 11 is fitted to the protrusion on base section 3A's side of chamber 3.

There is provided discharge pipe 14 for discharging the fuel (sucked by suck pump 11) to upper face 4A's side of fuel filter 4. In chamber 3, discharge pipe 14 has a base end side (lower in FIG. 2) connected to suck section 11B of suck pump 11. Moreover, discharge pipe 14 has a head end side (upper in FIG. 2) protruding through fuel filter 4 upward from chamber 3. The head end side (upper in FIG. 2) of discharge pipe 14 bends sideward (leftward in FIG. 2) in the vicinity of upper face 4A of fuel filter 4. On the head end side (upper in FIG. 2) of discharge pipe 14, there is formed a discharge port 14A for discharging the fuel. The fuel from discharge port 14A can flow downward, by its dead weight, into chamber 3 through fuel filter 4.

There is provided cover body 21 which is mounted to the wall of mount opening 2 of fuel tank 1 and constitutes a part of fuel tank 1. Cover body 21 can cover mount opening 2 and receive a motor section 25 (to be described afterward) of fuel pump 24 in such a manner that motor section 25 is disposed sidewise. Cover body 21 is shaped substantially into a stepped barrel. Cover body 21 is formed through a drawing, and is made of a metal, for example, a non-magnetic stainless, aluminum, copper and the like. Otherwise, cover body 21 is formed through an injection molding and the like of a resin material.

Figure 5:
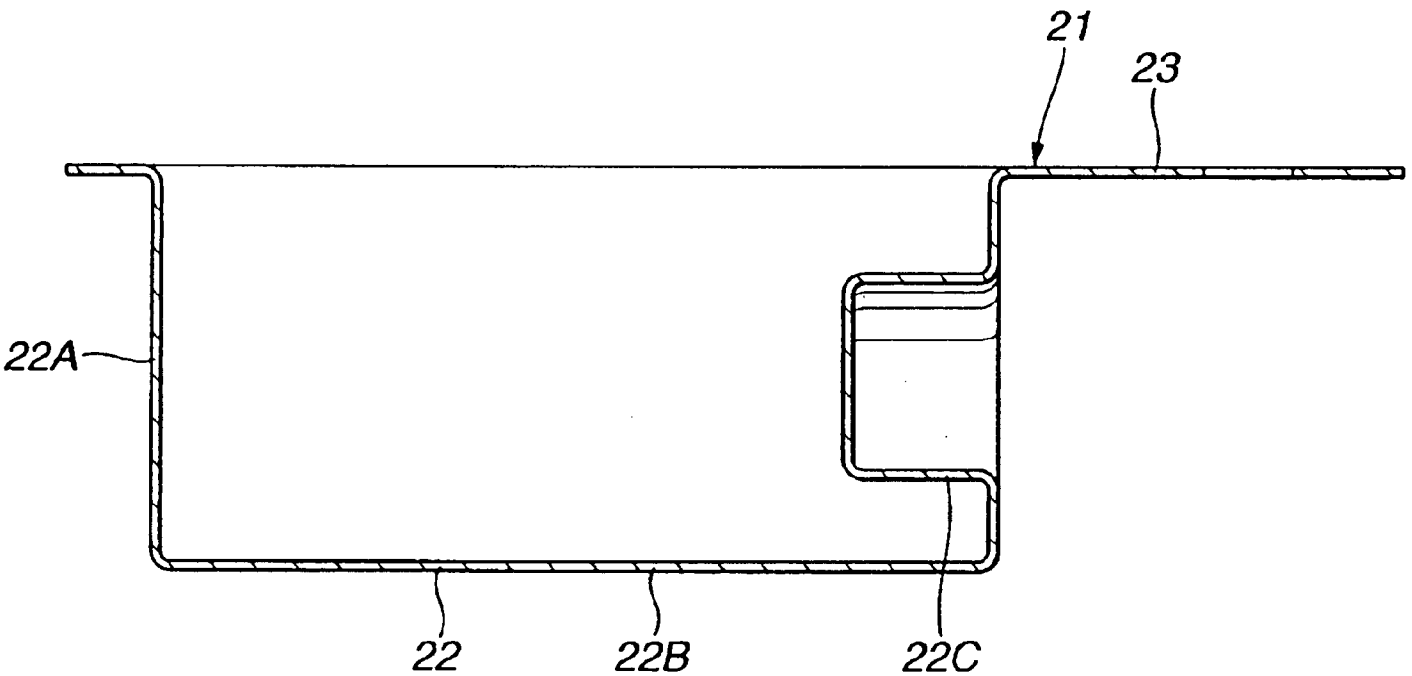
FIG. 5 shows an enlarged longitudinal cross section of a cover body 21 alone in FIG. 2, according to the first embodiment.

As is seen in FIG. 5, cover body 21 is, on the whole, constituted of a motor housing bulkhead 22 and flange section 23 which has an expanded diameter on an opening side of motor housing bulkhead 22. Motor housing bulkhead 22 of cover body 21 is inserted into mount opening 2, with flange section 23 mounted to upper plate 1B of fuel tank 1 with a screw member and the like (not shown).

Herein, motor section 25 of fuel pump 24 may be housed sidewise in motor housing bulkhead 22. Motor housing bulkhead 22 constitutes a sealing means for sealably separating motor section 25 from the fuel in fuel tank 1, thus bringing about an oil tightness. In other words, motor housing bulkhead 22, as is seen in FIG. 5, is a based barrel including: 1) a barrel section 22A (substantially rectangular) having a cross section shaped substantially into a lying English alphabet D, and 2) a base section 22B covering a lower side of barrel section 22A. Moreover, barrel section 22A is formed with a concave barrel section 22C which is concaved sidewise and has a base.

In motor housing bulkhead 22, motor section 25 of fuel pump 24 and a female joint 30 (to be described afterward) of a magnet joint 29 (to be described afterward) can be disposed sidewise, in a position along an axial line of concave barrel section 22C. Around motor section 25 in motor housing bulkhead 22, there is provided an electric part (not shown) including a control unit (not shown, for controlling fuel pump 24), a sensing section (not shown) of a fuel gauge (not shown), and the like. On the other hand, inside concave barrel section 22C (namely, outside motor housing bulkhead 22), there is provided a rotatable male joint 31 (to be described afterward) of magnet joint 29.

Figure 6:
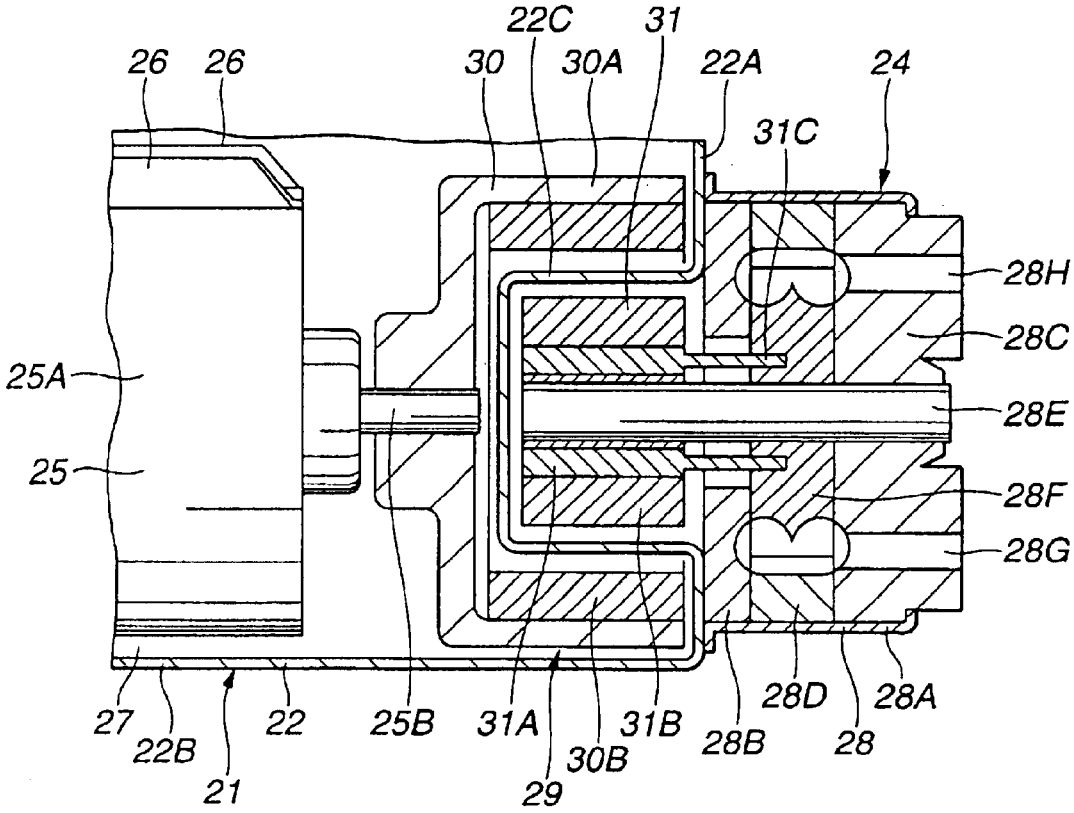
FIG. 6 shows an enlarged longitudinal cross section of an essential part of a motor housing bulkhead 22 and a fuel pump 24 in FIG. 2, according to the first embodiment.

As is seen in FIG. 6, concave barrel section 22C of motor housing bulkhead 22 has an outer periphery formed with an outer magnet 30B (to be described afterward) of female joint 30 constituting magnet joint 29, and has an inner periphery formed with an inner magnet 31B (to be described afterward) of male joint 31. With the above constitution, concave barrel section 22C can substantially radially overlap outer magnet 30B of female joint 30 with inner magnet 31B of male joint 31, thus keeping the sealed separation of motor section 25 from the fuel and encouraging magnetic coupling, resulting in an efficient rotational speed conveyance of motor section 25 to pump section 28.

There is provided fuel pump 24 which is a rotational source of the fuel supply unit. Fuel pump 24 is, for example, of an inner rotor type or an outer rotor type.

Fuel pump 24 may suck the fuel in fuel tank 1 (chamber 3), and then supply the thus sucked fuel to engine body 32's side. Moreover, fuel pump 24 is, on the whole, constituted of motor section 25 and pump section 28 (to be described afterward).

There is provided motor section 25 housed sidewise in motor housing bulkhead 22 (of cover body 21) sealably separating motor section 25 from the fuel in fuel tank 1. As is seen in FIG. 2 and FIG. 6, motor section 25 is, on the whole, constituted of a motor case 25A, a stator (not shown) fixed on an inner periphery of motor case 25A, a rotor (not shown) rotatably disposed inside the stator (not shown), a pair of brushes (not shown) for energizing the rotor (not shown), and an output shaft 25B disposed on a rotation center of the rotor (not shown) in such a manner as to rotate substantially integrally with the rotor (not shown). Output shaft 25B has a first end (right in FIG. 2) protruding outward from motor case 25A.

Hereinabove, being sealably separated from the fuel in fuel tank 1 by motor housing bulkhead 22, the motor 25 can be free from contacting the fuel. Thereby, motor case 25A, the stator (not shown), the rotor (not shown), the brushes (not shown), output shaft 25B and the like can be made of a low-priced material with no oil-proof.

There is provided a heat radiator 26 having a plurality of fins mounted to motor case 25A of motor section 25. On an upper side of motor case 25A, the fins of heat radiator 26 extend substantially axially at a regular interval circumferentially. Each of the fins of heat radiator 26 can aggressively radiate the heat (which may be caused when motor section 25 is operated) in the atmosphere, thus lowering the temperature of motor section 25, resulting in improved durability of motor section 25.

There is defined a heat insulation space 27 as a heat insulating means between barrel section 22A of motor housing bulkhead 22 and motor case 25A of motor section 25. Heat insulation space 27 can insulate the heat (which may be caused by operation of motor section 25) from being conveyed to the fuel in fuel tank 1.

Substantially coaxially with motor section 25, there is provided pump section 28 disposed outside motor housing bulkhead 22. Pump section 28 is, for example, of a turbine vane type. As is seen in FIG. 6, pump section 28 is, on the whole, constituted of a pump case 28A, an inner housing 28B cased in pump case 28A, an outer housing 28C, an annular housing 28D sandwiched between inner housing 28B and outer housing 28C, a shaft section 28E, and a turbine vane 28F. Pump case 28A shaped substantially into a barrel is fixed to an outer periphery of barrel section 22A by means of welding, adhesion and the like. Shaft section 28E has: a first side (right in FIG. 6) fixed in substantially a center section of both of inner housing 28B and outer housing 28C, and a second side (left in FIG. 6) extending into concave barrel section 22C of motor housing bulkhead 22. Turbine vane 28F is sandwiched between inner housing 28B and outer housing 28C, and is rotatably disposed around an outer periphery of shaft section 28E.

Moreover, outer housing 28C has: intake port 28G for taking therein the fuel (in chamber 3) by way of inner intake filter 7 and suck pipe 6, and discharge port 28H for discharging the thus taken fuel to fuel supply pipe 8.

Between motor section 25 and pump section 28, there is provided magnet joint 29 which is of a non-contact type. Magnet joint 29 may convey the rotational speed of motor section 25 to pump section 28, with concave barrel section 22C of motor housing bulkhead 22 having no contact with female joint 30 and male joint 31 which two members on the whole constituting magnet joint 29.

Female joint 30 of magnet joint 29 is disposed in motor housing bulkhead 22 and is rotatable by means of motor section 25. Male joint 31 of magnet joint 29 is disposed outside motor housing bulkhead 22. Being interlocked with female joint 30, male joint 31 can drive pump section 28.

Figure 7:
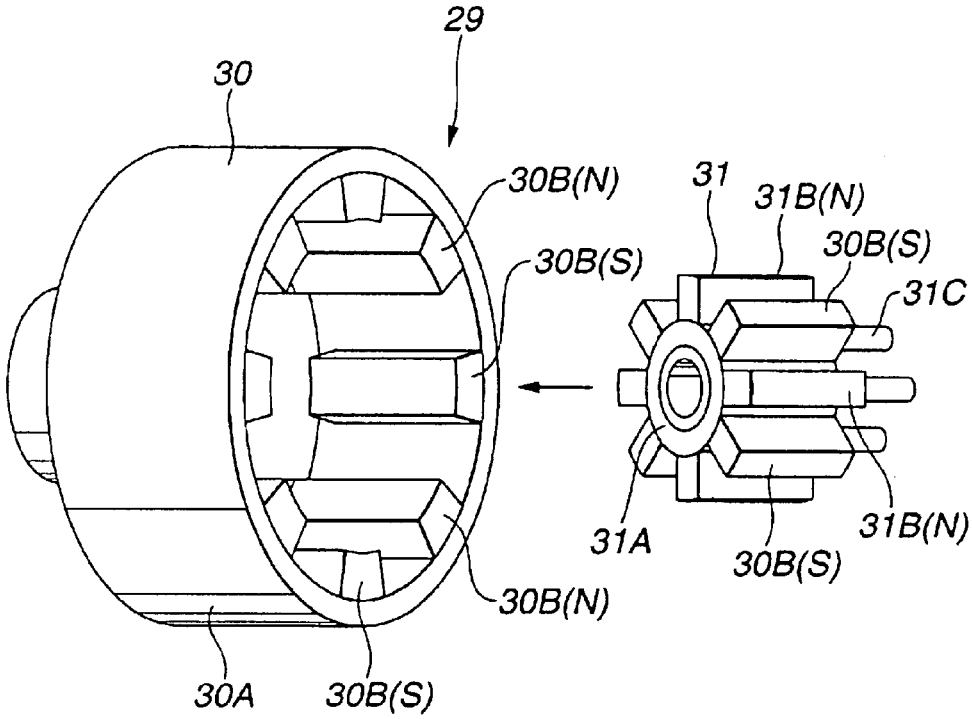
FIG. 7 shows an enlarged perspective view of a magnet joint 29, according to the first embodiment.

As is seen in FIG. 6 and FIG. 7, female joint 30 of magnet joint 29 includes a magnet mounting barrel 30A and a plurality of outer magnets 30B. Magnet mounting barrel 30A shaped substantially into a covered barrel can surround concave barrel section 22C of motor housing bulkhead 22. On an inner periphery of magnet mounting barrel 30A, outer magnet 30B (S pole) and outer magnet 30B (N pole) are alternately disposed circumferentially. Magnet mounting barrel 30A is mounted to output shaft 25B of motor section 25.

As is seen in FIG. 6 and FIG. 7, male joint 31 of magnet joint 29 includes a hollow magnet mounting shaft 31A and a plurality of inner magnets 31B. Magnet mounting shaft 31A is disposed inside concave barrel section 22C of motor housing bulkhead 22 and is rotatably supported by shaft section 28E of pump section 28. On an outer periphery of magnet mounting shaft 31A, inner magnet 31B (S pole) and inner magnet 31B (N pole) are alternately disposed circumferentially. Magnet mounting shaft 31A is connected to turbine vane 28F by way of an engagement protrusion 31C extending toward pump section 28.

Outer magnet 30B of female joint 30 and inner magnet 31B of male magnet 31 sandwiching therebetween concave barrel section 22C of motor housing bulkhead 22 may magnetically attract each other, thus rotating female joint 30 together with male joint 31. With the above operation, when motor section 25 (sealably separated from the fuel) in motor housing bulkhead 22 is driven, magnet joint 29 can rotate pump section 28 (disposed on the fuel side) with concave barrel section 22C sandwiched (no contact) between outer magnet 30B and inner magnet 31B.

Figure 1:
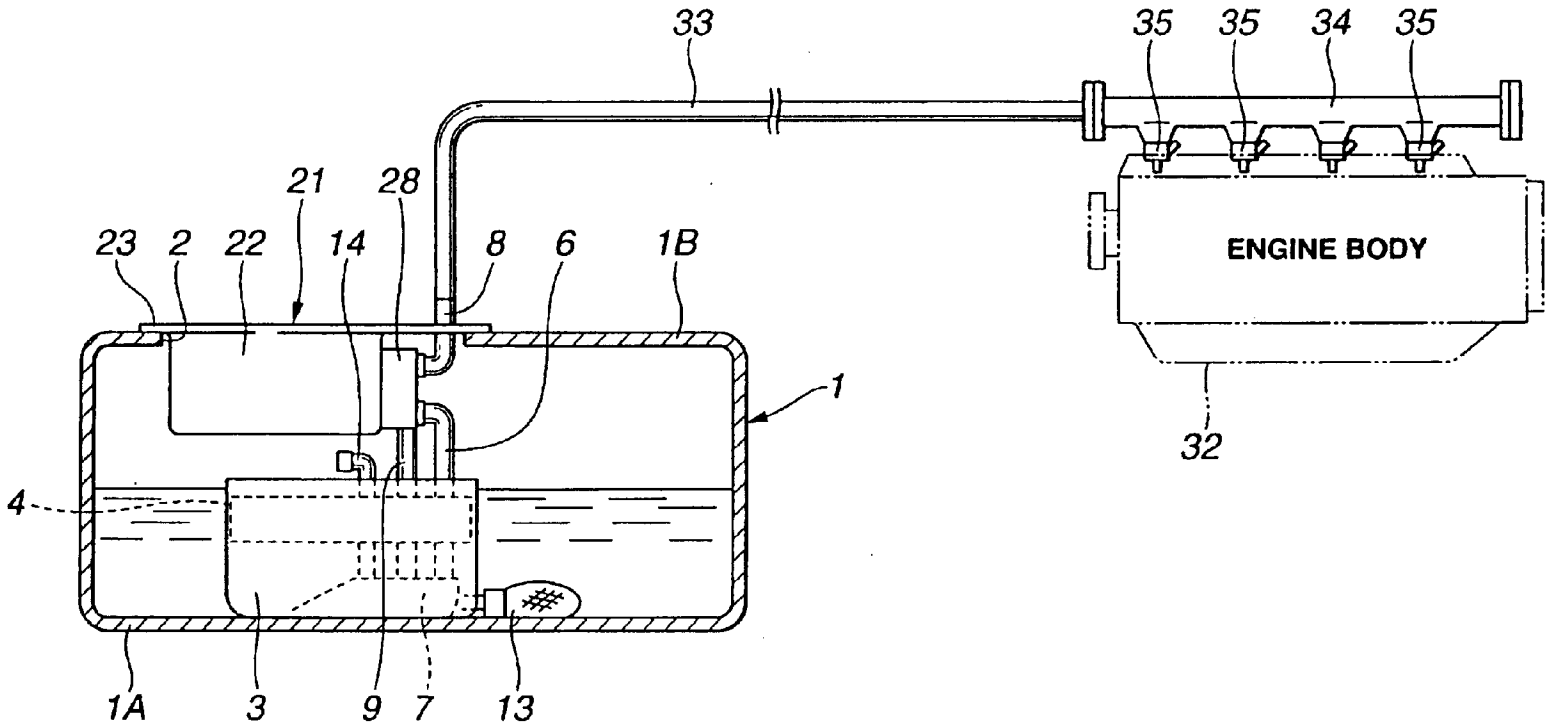
FIG. 1 shows a systematic diagram of a fuel supply system using a fuel supply unit, according to a first embodiment of the present invention.

On the other hand, as is seen in FIG. 1, there are provided engine body 32 and first pipe 33 for supplying the fuel to engine body 32. First pipe 33 has a first side (left in FIG. 1) connected to fuel supply pipe 8 of the fuel supply unit. Moreover, first pipe 33 has a second side (right in FIG. 1) connected to second pipe 34 mounted to engine body 32. Each of injection valves 35 is mounted corresponding to one of cylinders of engine body 32.

<First Embodiment—Operation>

Hereinafter described is operation of the fuel supply unit applied to the engine of the vehicle, according to the first embodiment of the present invention.

Energizing motor section 25 of fuel pump 24 may rotate output shaft 25B of motor section 25, thus rotating female joint 30 of magnet joint 29. Herein, motor section 25 and female joint 30 are disposed inside motor housing bulkhead 22 separating the fuel, while pump section 28 (to be driven) is disposed outside motor housing bulkhead 22. Female joint 30 of magnet joint 29 is, however, magnetically connected to male joint 31 disposed outside motor housing bulkhead 22, allowing conveyance of the rotational speed of female joint 30 to male joint 31, thus rotating turbine vane 28F of pump section 28 by way of male joint 31.

With the above operation, pump section 28 can suck the fuel (in chamber 3) from intake port 28G by way of inner intake filter 7 and suck pipe 6, and then discharge the thus sucked fuel from discharge port 28H to fuel supply pipe 8. In this case, a part of the fuel (indicated by an arrow A in FIG. 2) can be supplied from fuel supply pipe 8 to each of injection valves 35 by way of first pipe 33, second pipe 34 and the like, thereby injecting the fuel to each of cylinders of engine body 32 from one of injection valves 35.

A part of the fuel discharged through orifice section 10 (indicated by an arrow B in FIG. 2) may enter the nozzle section 11A of suck pump 11 by way of pipe 9, thus operating suck pump 11. With the above operation of suck pump 11, the fuel (indicated by an arrow C) in fuel tank 1 can be suck from outside chamber 3 toward inside chamber 3 by way of outer intake filter 13 and suck pipe 12. From discharge pipe 14 to upper face 4A of fuel filter 4, the fuel is then discharged together with the fuel in pipe 9 (indicated by an arrow D in FIG. 2).

Hereinabove, the fuel discharged from discharge pipe 14 can flow downward in fuel filter 4 by its dead weight for purging when the fuel level of fuel tank 1 is lower than the open end of chamber 3. The thus purged fuel can enter fuel reservoir 5. On the other hand, when the fuel level of fuel tank 1 is higher than the open end of chamber 3, fuel pump 24 may suck the discharged fuel into chamber 3 through the filter 4 together with a surrounding fuel.

With the above operation, intake port 28G' side of fuel pump 24 can store a certain amount of fuel, including the fuel entering fuel reservoir 5 and the fuel through fuel filter 4. With this, fuel pump 24 can stably suck and discharge the fuel (in chamber 3) even when the fuel level in fuel tank 1 is lowered or inclined.

Motor section 25 is housed in motor housing bulkhead 22 with the fuel (in fuel tank 1) sealably separated. With this, temperature increase which may be caused by operation of motor section 25 can be prevented. Moreover, defining heat insulation space 27 in the following areas can assuredly insulate the heat caused by operation of motor section 25:

Area 1. between motor section 25, and barrel section 22A of motor housing bulkhead 22, and Area 2. between motor section 25, and base section 22B of motor housing bulkhead 22.

According to the first embodiment, motor housing bulkhead 22 for sealably separating the fuel (including vapor) in fuel tank 1 is fitted to cover body 21 which constitutes fuel tank 1. In addition, according to the first embodiment, motor section 25 of fuel pump 24 is housed in motor housing bulkhead 22. With the above constitution, motor section 25 can be assuredly prevented from contact with fuel tank 1.

The above fuel separated from motor section 25 can be free from mixture of wear powder and the like which may be caused by operation of motor section 25. With this, fuel filter 4 and the like can be low in terms of capacity and performance, reducing dimension, cost and the like of fuel filter 4. Motor section 25 is allowed to be one that is low in price with no oil-proof. Moreover, motor section 25 can be free from fuel resistance, thus preventing rotation loss, resulting in low production cost.

Between motor section 25 and pump section 28, disposing non-contact type magnet joint 29 conveying the rotational speed can eliminate the need for another seal member and the like for preventing entry of the fuel into motor housing bulkhead 22. In other words, even without the another seal member, motor housing bulkhead 22 can sealably separate motor section 25 from the fuel in fuel tank 1, thus improving reliability and simplifying constitution.

Concave barrel section 22C of motor housing bulkhead 22 can be sandwiched between female joint 30 and male joint 31, in other words, concave barrel section 22C can be overlapped substantially radially with outer magnet 30B of female joint 30 and inner magnet 31B of male joint 31. With the above constitution, concave barrel section 22C can enhance magnetic coupling by magnet joint 29 while sealing against the fuel is kept, thus conveying efficiently the rotational speed of motor section 25 to pump section 28.

On the other hand, motor section 25 sealably separated from the fuel in fuel tank 1 defines heat insulation space 27 between motor section 25 and motor housing bulkhead 22. With the above constitution, the heat (which may be caused by operation of motor section 25) can be prevented from being conveyed to the fuel, thus preventing the fuel temperature increase and further thus preventing in advance occurrence of the vapor and the like of the fuel.

Moreover, motor case 25A (of motor section 25) fitted with heat radiator 26 having the plurality of the fins can radiate the heat (which may be caused by operation of motor section 25), thus cooling motor section 25.

<Second Embodiment—Constitution>

Figure 8:
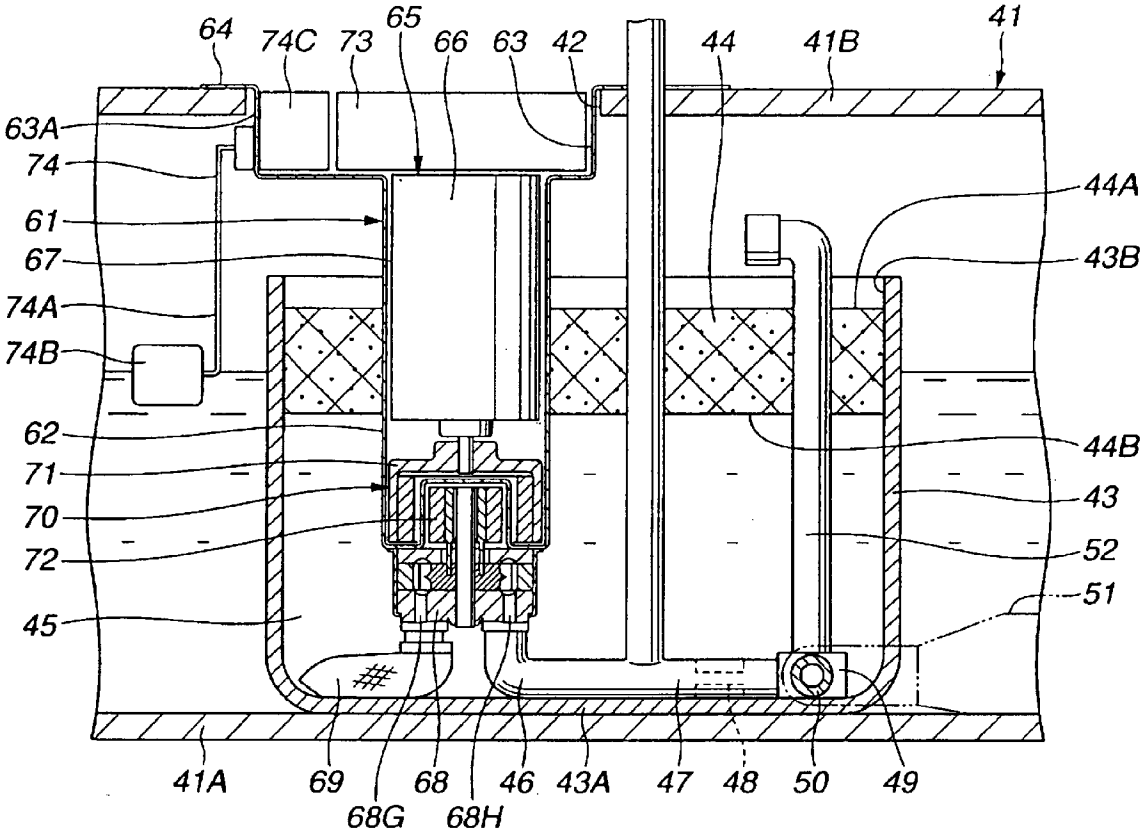
FIG. 8 shows an enlarged view of a longitudinal cross section of the fuel supply unit, according to a second embodiment.
Figure 9:
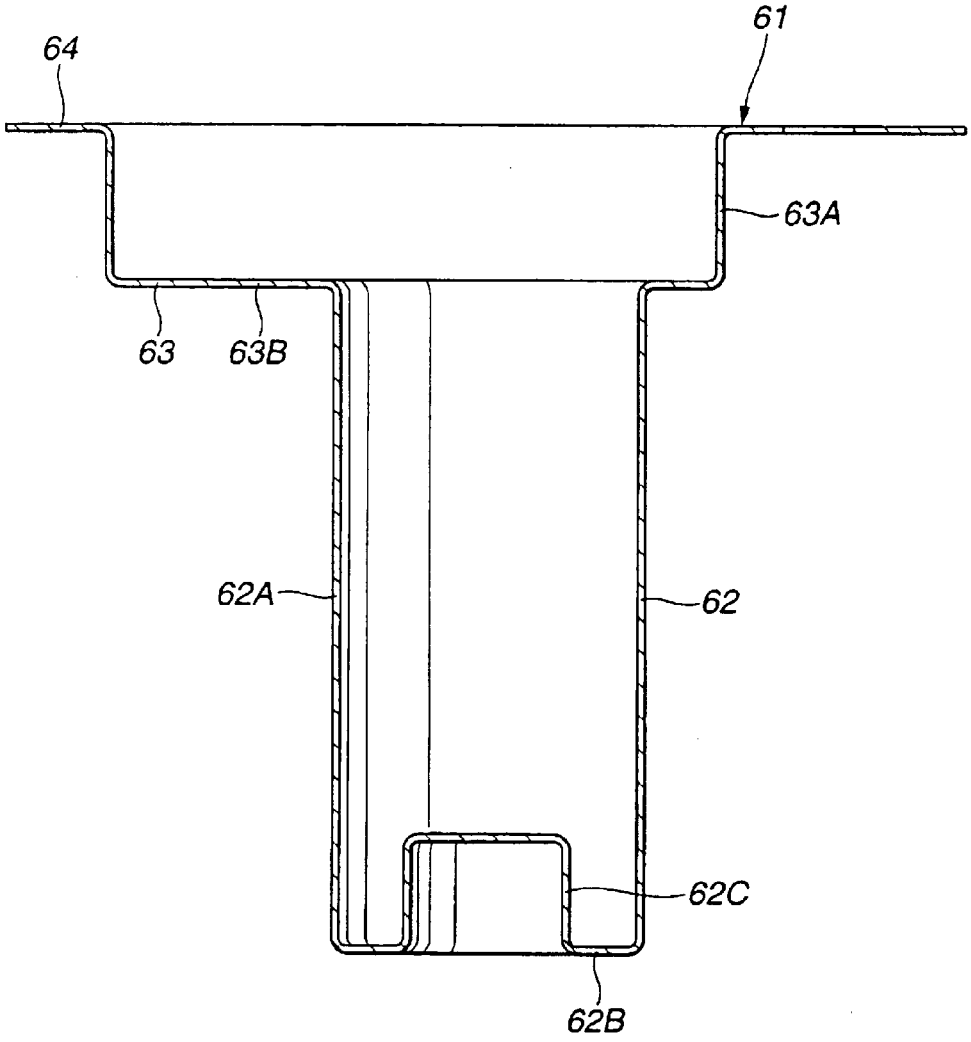
FIG. 9 shows an enlarged longitudinal cross section of a cover body 61 alone in FIG. 8, according to the second embodiment.
Figure 10:
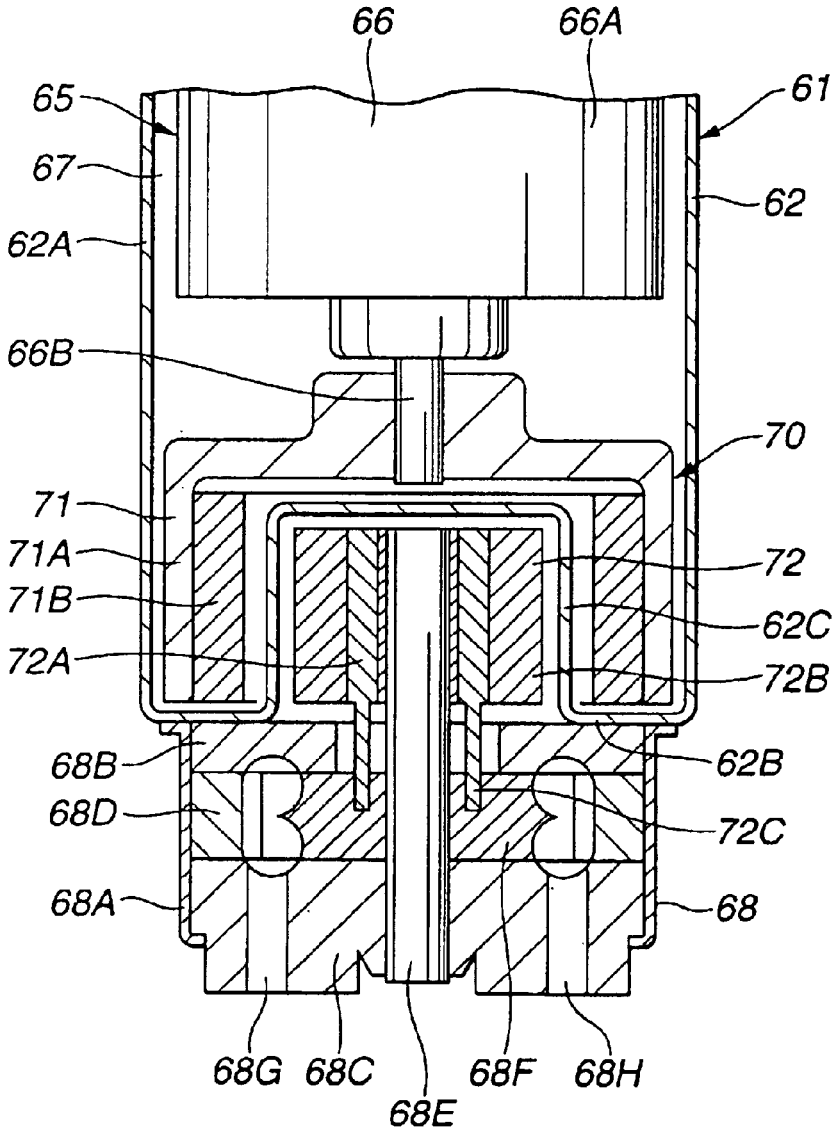
FIG. 10 shows an enlarged longitudinal cross section of an essential part of a motor housing bulkhead 62 and a fuel pump 65 in FIG. 8, according to the second embodiment.

FIG. 8 to FIG. 10 show the fuel supply unit applied to the engine of the vehicle, according to a second embodiment of the present invention.

According to the second embodiment, a motor section 66 (to be described afterward) of a fuel pump 65 (to be described afterward) is housed lengthwise in a motor housing bulkhead 62 (to be described afterward) of a cover body 61 (to be described afterward).

According to the second embodiment, parts and sections substantially the same as those according to the first embodiment are denoted by the same numerals, and repeated descriptions are to be omitted.

There is provided a fuel tank 41. Substantially like fuel tank 1 according to the first embodiment, fuel tank 41 includes a lower plate 41A and an upper plate 41B. Upper plate 41B is formed with a mount opening 42 having a wall for mounting cover body 61.

There is provided a chamber 43 disposed in fuel tank 41. Substantially like chamber 3 according to the first embodiment, chamber 43 is shaped substantially into a based barrel formed with a base section 43A and an open section 43B.

There is provided a fuel filter 44 mating with a wall on open section 43B's side of chamber 43. Substantially like fuel filter 4 according to the first embodiment, fuel filter 44 is a filter element shaped substantially into a plate having an upper face 44A and a lower face 44B. Substantially like fuel reservoir 5 according to the first embodiment, a fuel reservoir 45 (a partitioned area) is formed in chamber 43.

There is provided a fuel supply pipe 46 for supplying outward the fuel in fuel tank 41. Fuel supply pipe 46 has a base end side (lower and left in FIG. 8) connected to a discharge port 68H (to be described afterward) of a pump section 68 (to be described afterward). Fuel supply pipe 46 has a head end side (upper and right in FIG. 8) which is so bent substantially into an English alphabet L reversed sidewise (or a Japanese katakana character ㄱ) as to protrude out of fuel tank 41 through fuel filter 44. Moreover, the head end side (upper and right in FIG. 8) of fuel supply pipe 46 is connected to injection valve 35 by way of first pipe 33, second pipe 34 and the like in FIG. 1.

There is provided a pipe 47 for a suck pump 49 (to be described afterward). Pipe 47 supplies to suck pump 49 a part of the fuel pumped by fuel pump 65. Pipe 47 connects a way of supply pipe 46 to suck pump 49. Moreover, a way of pipe 47 is formed with an orifice section 48 (to be described afterward) for dividing the fuel from fuel pump 65 into one supplied to suck pump 49's side and the other supplied to injection valve 35's side.

There is provided suck pump 49 disposed in chamber 43. Substantially like suck pump 11 according to the first embodiment, suck pump 49 uses the part of the fuel pumped by fuel pump 65, so as to help convey the fuel from outside chamber 43 to upper face 44A of fuel filter 44.

Suck pump 49 has a suck side connected to a suck pipe 50. Suck pipe 50 has a protrusion end fitted with an outer intake filter 51. Suck pump 49 has a discharge side connected to a discharge pipe 52 protruding upward through fuel filter 44.

There is provided cover body 61 which is mounted to the wall of mount opening 42 of fuel tank 41 and constitutes a part of fuel tank 41. Cover body 61 can receive motor section 66 of fuel pump 65 (to be described afterward) in such a manner that motor section 66 is disposed lengthwise. Cover body 61 is shaped substantially into a stepped barrel. Cover body 61 is formed through a deep drawing, and is made of a metal, for example, a non-magnetic stainless, aluminum copper and the like. Otherwise, cover body 61 is formed through the injection molding and the like of the resin material.

As is seen in FIG. 9, cover body 61 is, on the whole, constituted of motor housing bulkhead 62, an electric part housing 63 and a flange section 64. Motor housing bulkhead 62 extending substantially axially (upward and downward) has a deep base and shaped substantially into a based barrel. Electric part housing 63 formed by increasing in diameter an opening side (upper) of motor housing bulkhead 62 has a shallower base than motor housing bulkhead 62. Flange section 64 is formed by increasing in diameter an opening side (upper) of electric part housing 63.

Herein, motor housing bulkhead 62 constitutes a sealing means for sealably separating motor section 66 from the fuel in fuel tank 41, thus bringing about the oil tightness.

Motor housing bulkhead 62 shaped substantially into a based barrel includes a barrel section 62A, a base section 62B and a concave barrel section 62C. Barrel section 62A extends upward and downward. Base section 62B disposed below barrel section 62A is shaped substantially into an annulus. Concave base section 62C is a based barrel which is bent from an inner periphery of base section 62B into barrel section 62A. Concave base section 62C is substantially coaxial with barrel section 62A.

Motor section 66 of fuel pump 66 may be so inserted into barrel section 62A of motor housing bulkhead 62 as to be disposed on an opening side (upper in FIG. 8) of barrel section 62A. On a base side (lower in FIG. 8) of barrel section 62A, a female joint 71 (to be described afterward) of a magnet joint 70 (to be described afterward) is rotatably disposed. Moreover, on an inner periphery of concave barrel section 62C, namely, outside motor housing bulkhead 62, a male joint 72 (to be described afterward) of magnet joint 70 is rotatably disposed.

Electric part housing 63 includes a barrel section 63A (short in dimension) and a base section 63B. Base section 63B is shaped by reducing in diameter a lower end section of barrel section 63A and is substantially flat. Base section 63B is formed with motor housing bulkhead 62. In electric part housing 63, there are provided a control unit 73 (to be described afterward) and a sensing section 74C of a fuel gauge 74 (to be described afterward).

The constitution and formation of cover body 61 can be summed up as follows: Cover body 61 can be shaped substantially into the stepped barrel through the deep drawing of the metal plate, or through the injection molding of the resin material. Into motor housing bulkhead 62, motor section 66 and the like of fuel pump 65 can be inserted with ease for installation, namely, eliminating the need for an additional fixture and the like. In electric part housing 63, control unit 73 and sensing section 74C of fuel gauge 74 can be housed.

There is provided fuel pump 65 which is, substantially like the fuel pump 24 according to the first embodiment, the rotational source of the fuel supply unit. Fuel pump 65 is, on the whole, constituted of motor section 66 and pump section 68.

There is provided motor section 66 housed in motor housing bulkhead 62 (of cover body 61) sealably separating motor section 66 from the fuel in fuel tank 41. As is seen in FIG. 10, motor section 66 has a motor case 66A incorporating therein a stator (not shown) and a rotor (not shown). Moreover, motor section 66 includes an output shaft 66B. Output shaft 66B is rotatable substantially integrally with the rotor (not shown), and has a first end protruding from a lower side of motor case 66A.

Herein, being sealably separated from the fuel in fuel tank 41 by motor housing bulkhead 62, motor section 66 can be free from contacting the fuel. Thereby, motor case 66A, the stator (not shown), the rotor (not shown), the brushes (not shown), output shaft 66B and the like can be made of the low-priced material with no oil-proof.

There is defined a heat insulation space 67 as a heat insulating means between barrel section 62A of motor housing bulkhead 62 and motor case 66A of motor section 66. Heat insulation space 67 can insulate the heat (which may be caused by operation of motor section 66) from being conveyed to the fuel in fuel tank 41.

Substantially coaxially with motor section 66, there is provided pump section 68 disposed outside motor housing bulkhead 62. Pump section 68 is, for example, of a turbine vane type. As is seen in FIG. 10, pump section 68 is, on the whole, constituted of a pump case 68A, an inner housing 68B, an outer housing 68C, an annular housing 68D, a shaft section 68E, and a turbine vane 68F. Outer housing 68C is formed with an intake port 68G and discharge port 68H. Intake port 68G is fitted with an inner intake filter 69, as is seen in FIG. 8.

Between motor section 66 and pump section 68, there is provided magnet joint 70 which is of a non-contact type. Magnet joint 70 may convey the rotational speed of motor section 66 to pump section 68, with concave barrel section 62C of motor housing bulkhead 62 having no contact with female joint 71 and male joint 72 which two members on the whole constituting magnet joint 70.

Substantially like female joint 30 and male joint 31 of magnet joint 29 according to the first embodiment, female joint 71 of magnet joint 70 is disposed in motor housing bulkhead 62 and is rotatable by means of motor section 66, while male joint 72 of magnet joint 70 is disposed outside motor housing bulkhead 62. Being interlocked with female joint 71, male joint 72 can drive pump section 68.

Herein, female joint 71 is formed with a magnet mounting barrel 71A, an outer magnet 71B and the like, while male joint 72 is formed with a magnet mounting shaft 72A, an inner magnet 72B, an engagement protrusion 72C and the like. With the above constitution, when motor section 66 in motor housing bulkhead 62 is driven, magnet joint 70 can rotate pump section 68 (disposed on the fuel side) with concave barrel section 62C sandwiched (no contact) between outer magnet 71B and inner magnet 72B.

As is seen in FIG. 8, there is provided control unit 73 housed in electric part housing 63. Control unit 73 can so control rotational speed of motor section 66 as to control flow rate of the fuel (supplied fuel pressure) discharged from pump section 68.

There is provided fuel gauge 74 for sensing the fuel level (remaining amount) in fuel tank 41. Fuel gauge 74 is, on the whole, constituted of an arm 74A, a float 74B, and sensing section 74C. Arm 74A on a base end side (lower in FIG. 8) of fuel gauge 74 is swingable on barrel section 63A's side of electric part housing 63 constituting cover body 61. Float 74B is mounted to a head end (lower in FIG. 8) of arm 74A. Sensing section 74C in electric part housing 63 may sense an angle of swung arm 74A referring to, for example, displacement of the electric resistance of swung arm 74A. For preventing outflow of the fuel to sensing section 74C' side; a seal member (not shown in FIG. 8) is provided between arm 74A and sensing section 74C, otherwise, arm 74A and sensing section 74C can make a non-contact connection with each other by means of a magnet joint (not shown in FIG. 8).

<Second Embodiment—Operation>

The fuel supply unit applied to the engine of the vehicle according to the second embodiment of the present invention can bring about substantially the same effect and operation as those obtained by the fuel supply unit according to the first embodiment.

Especially, the fuel supply unit according to the second embodiment has motor housing bulkhead 62 (for housing therein motor section 66 of fuel pump 65) that can be formed with ease through the deep drawing and the like. Motor section 66 can be mounted with ease in motor housing bulkhead 62, without the need for preparing or forming the following:

1. a cover,
2. a fixture including a screw member and the like,
3. an engagement section for engaging the fixture, or
4. a screw opening and the like.

<Third Embodiment—Constitution>

Figure 11:
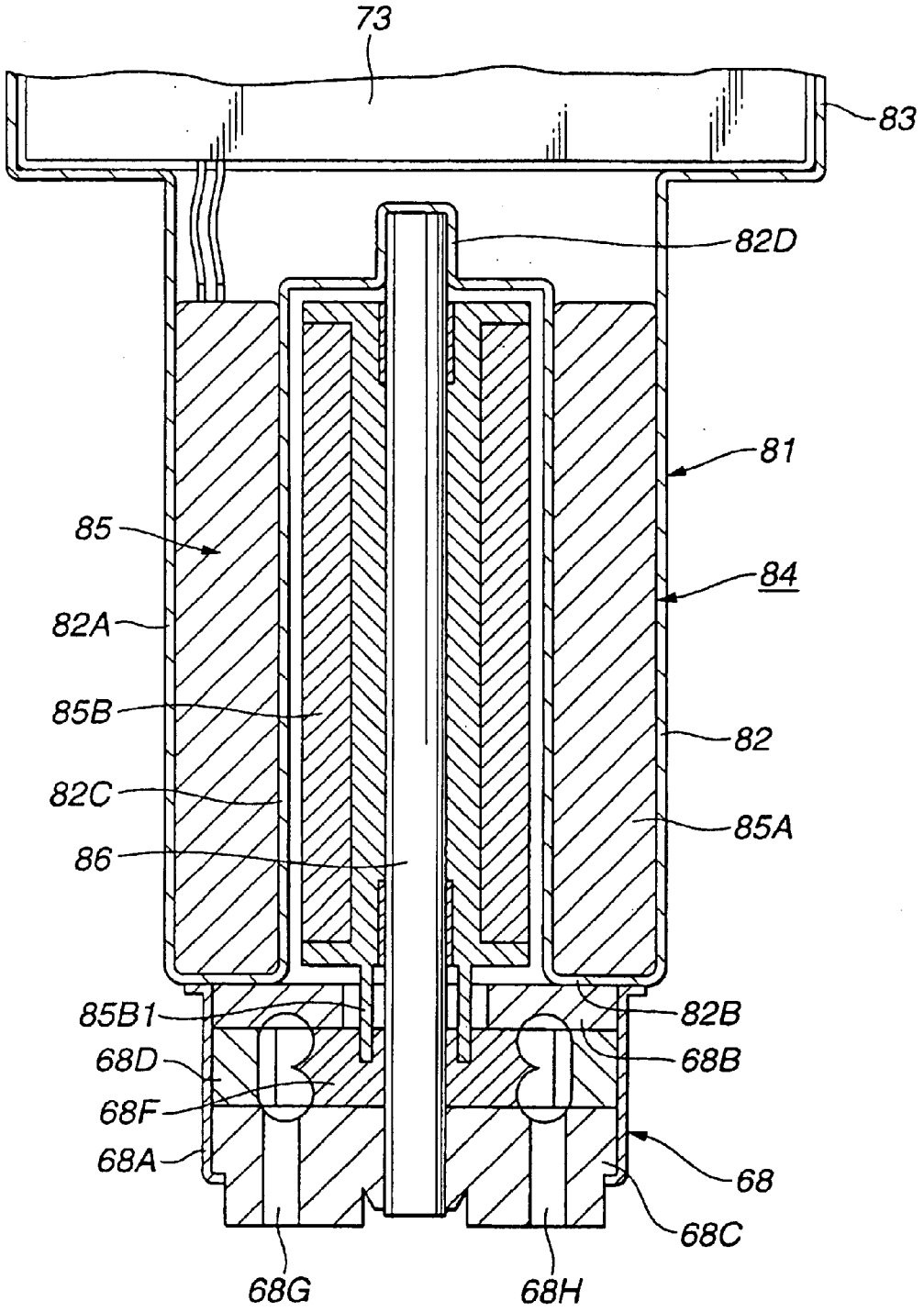
FIG. 11 shows an enlarged longitudinal cross section of an essential part of a motor housing bulkhead 82 (of a cover body 81), a motor section 85 (of a fuel pump 84) and the like, according to a third embodiment.

FIG. 11 shows the fuel supply unit applied to the engine of the vehicle, according to a third embodiment of the present invention.

According to the third embodiment, a motor section of a fuel pump uses an inner rotor. In a motor housing bulkhead, a stator is housed which constitutes a first part of the motor section of the fuel pump. Outside the motor housing, a pump section and the inner rotor are disposed, wherein the inner rotor constitutes a second part of the motor section.

According to the third embodiment, parts and sections substantially the same as those according to the second embodiment are denoted by the same numerals, and repeated descriptions are to be omitted.

There is provided a cover body 81. Substantially like cover body 61 according to the second embodiment, cover body 81 is shaped substantially into a stepped barrel. Moreover, cover body 81 is formed through the deep drawing, and is made of a metal, for example, the non-magnetic stainless, aluminum copper and the like. Otherwise, cover body 81 is formed through the injection molding and the like of the resin material.

Cover body 81 according to the third embodiment is, however, different from cover body 61 according to the second embodiment, in terms of shape of motor housing bulkhead, namely, motor housing bulkhead 62 (second embodiment) compared with a motor housing bulkhead 82 (third embodiment).

There is provided the motor housing bulkhead 82 constituting a sealing means. Substantially like motor housing bulkhead 62 according to the second embodiment, motor housing bulkhead 82 according to the third embodiment includes a barrel section 82A, a base section 82B (annular) and a concave barrel section 82C, thus forming a based barrel extending substantially axially. Motor housing bulkhead 82 according to the third embodiment is, however, different from motor housing bulkhead 62 from the following points:

1. Concave barrel section 82C greatly (namely, greater than concave barrel section 62C according to the second embodiment) inroads into barrel section 82A.
2. Substantially an innermost base (upper in FIG. 11) of concave barrel section 82C is formed with a bearing barrel section 82D.

There is provided an electric part housing 83 formed on an opening side (upper in FIG. 11) of motor housing bulkhead 82. A flange section (not shown in FIG. 11) is formed by increasing in diameter an opening side of electric part housing 83. Substantially like control unit 73 according to the second embodiment, electric part housing 83 can house therein control unit 73 and the like.

There is provided a fuel pump 84 using a motor section 85 of inner rotor type. With this, fuel pump 84 is constituted of motor section 85 and pump section 68 which is substantially like pump section 68 according to the second embodiment.

There is provided motor section 85 which constitutes fuel pump 84 and is of inner rotor type. Motor section 85 is, on the whole, constituted of a stator 85A and an inner rotor 85B. Stator 85A housed in motor housing bulkhead 82 and sandwiched between barrel section 82A and concave barrel section 82C constitutes a first part of motor section 85, while inner rotor 85B disposed outside motor housing 82 (namely, inside concave barrel section 82C) constitutes a second part of motor section 85.

Herein, inner rotor 85B is rotatably born by a bearing shaft 86 having a first end (upper in FIG. 11) mounted to bearing barrel section 82D of motor housing bulkhead 82 and a second end (lower in FIG. 11) mounted to outer housing 68C of pump section 68.

An engagement protrusion 85B1 engages with turbine vane 68F of pump section 68 in such a manner as to rotate substantially integrally with turbine vane 68F.

Herein, stator 85A and inner rotor 85B constituting motor section 85 sandwich therebetween concave barrel section 82C of motor housing bulkhead 82. With the above constitution, energizing stator 85A can rotate inner rotor 85B with no contact. With the above operation, stator 85A housed in motor housing bulkhead 82 can be sealably separated from the fuel in fuel tank 41 by means of motor housing bulkhead 82.

<Third Embodiment—Operation>

The fuel supply unit applied to the engine of the vehicle according to the third embodiment of the present invention can bring about substantially the same effect and operation as those obtained by the fuel supply unit according to the first embodiment and the fuel supply unit according to the second embodiment.

Especially, the fuel supply unit according to the third embodiment can eliminate a magnet joint (namely, magnet joint 29 according to the first embodiment, and magnet joint 70 according to the second embodiment), thus simplifying constitution of the fuel supply unit and reducing size.

<Fourth Embodiment—Constitution>

Figure 12:
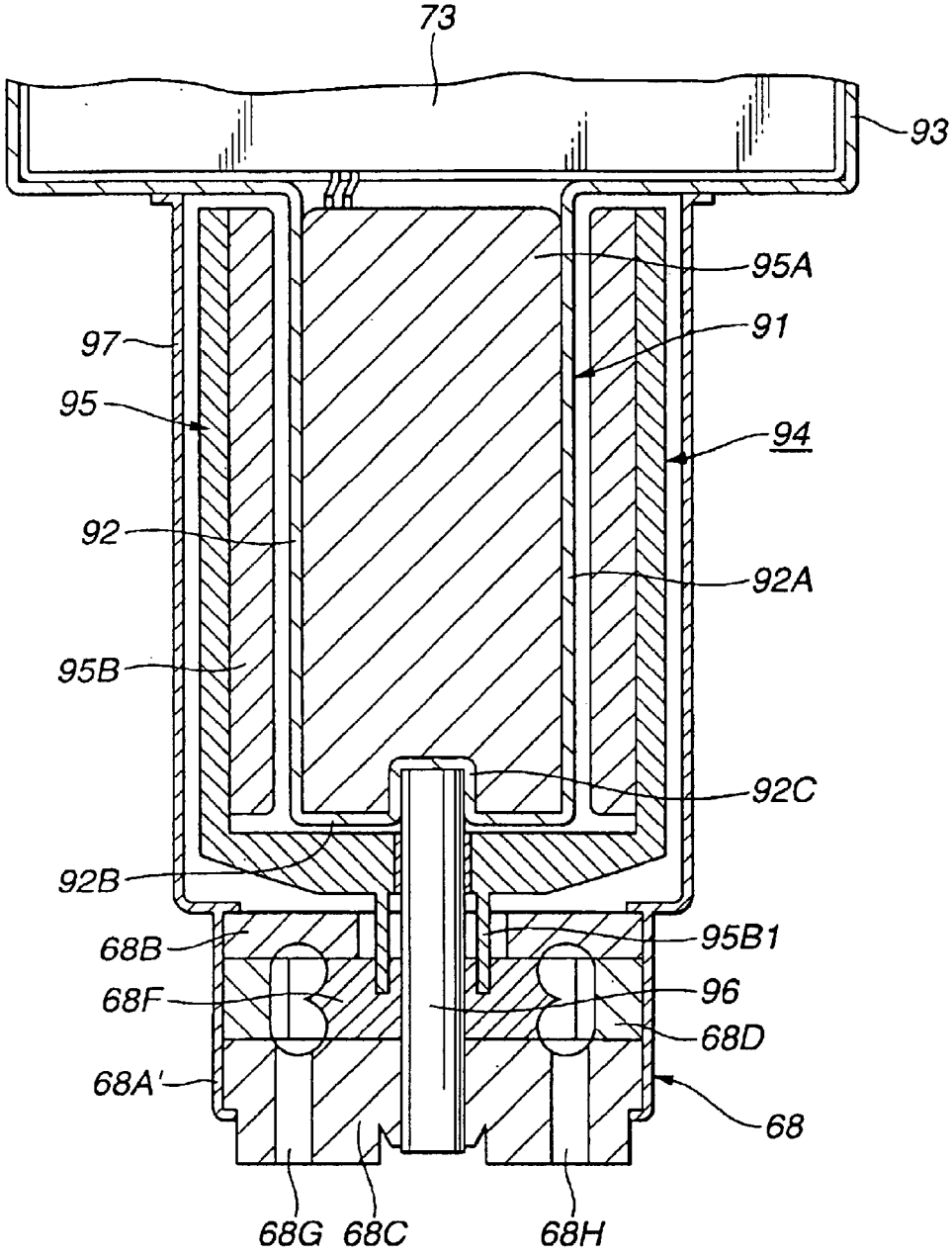
FIG. 12 shows an enlarged longitudinal cross section of an essential part of a motor housing bulkhead 92 (of a cover body 91), a motor section 95 (of a fuel pump 94) and the like, according to a fourth embodiment.

FIG. 12 shows the fuel supply unit applied to the engine of the vehicle, according to a fourth embodiment of the present invention.

According to the fourth embodiment, a motor section of the fuel pump uses an outer rotor. In a motor housing bulkhead, a stator is housed which constitutes a first part of the motor section of the fuel pump. Outside the motor housing, a pump section and the outer rotor are disposed, wherein the outer rotor constitutes a second part of the motor section.

According to the fourth embodiment, parts and sections substantially the same as those according to the second embodiment are denoted by the same numerals, and repeated descriptions are to be omitted.

There is provided a cover body 91. Substantially like cover body 61 according to the second embodiment, cover body 91 is shaped substantially into a stepped barrel. Moreover, cover body 91 is formed through the deep drawing, and is made of a metal, for example, the non-magnetic stainless, aluminum copper and the like. Otherwise, cover body 91 is formed through the injection molding and the like of the resin material.

There is provided a motor housing bulkhead 92 constituting a sealing means. Motor housing bulkhead 92 including a barrel section 92A and a base section 92B is formed into a based barrel. Compared with barrel section 62A of motor housing bulkhead 62 according to the second embodiment, barrel section 92A according to the fourth embodiment is smaller in diameter. Base section 92B may block a lower side of barrel section 92A. Substantially in a center of base section 92B, there is formed a concave barrel section 92C.

There is provided an electric part housing 93 formed on an opening side (upper in FIG. 12) of motor housing bulkhead 92. A flange section (not shown in FIG. 12) is formed by increasing in diameter an opening side of electric part housing 93. Substantially like control unit 73 according to the second embodiment, electric part housing 93 can house therein control unit 73 and the like.

There is provided a fuel pump 94 using a motor section 95 of outer rotor type. With this, fuel pump 94 is constituted of motor section 95 and pump section 68 which is substantially like pump section 68 according to the second embodiment.

There is provided motor section 95 which constitutes fuel pump 94 and is of outer rotor type. Motor section 95 is, on the whole, constituted of a stator 95A and an outer rotor 95B. Stator 95A housed in barrel section 92A of motor housing bulkhead 92 constitutes a first part of motor section 95, while outer rotor 95B disposed outside barrel section 92A of motor housing bulkhead 92 constitutes a second part of motor section 95.

Herein, outer rotor 95B covering barrel section 92A is shaped substantially into a based barrel. Outer rotor 95B has a base section (lower in FIG. 12) which is rotatably born by a bearing shaft 96 and which engages with turbine vane 68F of pump section 68 by way of an engagement protrusion 95B1.

Herein, stator 95A and outer rotor 95B constituting motor section 95 sandwich therebetween barrel section 92A of motor housing bulkhead 92. With the above constitution, energizing stator 95A can rotate outer rotor 95B with no contact. With the above operation, stator 95A housed in motor housing bulkhead 92 can be sealably separated from the fuel in fuel tank 41 by means of motor housing bulkhead 92.

There is provided a barrel cover 97 for covering an outer periphery of outer rotor 95B. Barrel cover 97 has a head end side (lower in FIG. 12) formed with a pump case 68A'.

<Fourth Embodiment—Operation>

The fuel supply unit applied to the engine of the vehicle according to the fourth embodiment of the present invention can bring about substantially the same effect and operation as those obtained by the fuel supply unit according to the first embodiment, the fuel supply unit according to the second embodiment, and the fuel supply unit according to the third embodiment.

Although the present invention has been described above by reference to the four embodiments, the present invention is not limited to the four embodiments described above. Modifications and variations of the embodiment described above will occur to those skilled in the art, in light of the above teachings.

More specifically, according to the first embodiment of the present invention, fuel tank 1 has lower plate 1A that is separated from base section 3A of chamber 3. The present invention is, however, not limited to the above constitution. Base section 3A of chamber 3 can constitute a part of a base plate of fuel tank 1. This constitution can be applicable likewise to the second embodiment, the third embodiment, and the fourth embodiment.

In addition, according to the first embodiment of the present invention, motor housing bulkhead 22 is mounted to cover body 21 that is fitted to fuel tank 1. The present invention is, however, not limited to the above constitution. A part of upper plate 1B of fuel tank 1, for example, can be so machined as to be dent downward for providing a space for motor housing bulkhead 22. This constitution can be applicable likewise to the second embodiment, the third embodiment, and the fourth embodiment.

Moreover, according to the first embodiment of the present invention, heat insulation space 27 is defined between:

1. barrel section 22A of motor housing bulkhead 22, and motor case 25A of motor section 25, and between
2. base section 22B of motor housing bulkhead 22, and motor case 25A of motor section 25.

Having the above constitution, heat insulation space 27 can prevent the heat (which maybe caused by operation of motor section 25) in motor housing bulkhead 22 from being conveyed to the fuel in fuel tank 1. The present invention is, however, not limited to the above. Heat insulation space 27 can be replaced with an insulation material and the like. Otherwise, motor housing bulkhead 22, as it is, can be made of an insulation material and the like. These replaceable constitutions can be applicable likewise to the second embodiment, the third embodiment, and the fourth embodiment.

According to each of the first embodiment, the second embodiment, the third embodiment, and the fourth embodiment, pump section 28, 68, 68, 68 is of the turbine vane 28F, 68F, 68F, 68F type. The present invention is, however, not limited to the above. The turbine vane 28F, 68F, 68F, 68F type can be replaced with another rotary type, including trochoid, gear and the like. Otherwise, the turbine vane 28F, 68F, 68F, 68F type can be replaced with a reciprocating type.

This application is based on a prior Japanese Patent Application No. P2002-355335 (filed on Dec. 6, 2002 in Japan). The entire contents of the Japanese Patent Application No. P2002-355335 from which priority is claimed is incorporated herein by reference, in order to take some protection against mis-translation or omitted portions.

The scope of the present invention is defined with reference to the following claims.

What is claimed is:

1. A fuel supply unit, comprising:

1) a fuel pump comprising;
   i) a motor section, and
   ii) a pump section driven by the motor section, the pump section pumping a fuel; and 2) a fuel tank for tanking therein the fuel to be pumped by the pump section and to be discharged out of the fuel tank by the pump section, the fuel tank being provided with;
   i) a motor housing bulkhead sunk into the fuel tank, the motor housing bulkhead comprising;
      a) an inner section for housing therein one of the following:
         α) the motor section, and
         β) a first part of the motor section,
      b) an outer section provided with one of the following:
         α) the pump section, with the motor section housed in the inner section, and
         β) the pump section and a second part of the motor section, with the first part of the motor section housed in the inner section,
      the inner section of the motor housing bulkhead being substantially sealably separated from the outer section of the motor housing bulkhead, in such a manner as to bring about an oil tightness.

2. The fuel supply unit as claimed in claim 1, wherein a rotational speed of the motor section is conveyable in one of the following states:

1) a first state free from a contact between the motor section and the pump section which sandwich therebetween the motor housing bulkhead, and
2) a second state free from a contact between the first part of the motor section and the second part of the motor section, the first part and the second part sandwiching therebetween the motor housing bulkhead.

3. The fuel supply unit as claimed in claim 2, wherein one of the following positions is so constituted that a heat in the motor housing bulkhead is insulated and thereby the heat is prevented from being conveyed to the fuel in the fuel tank:

1) a first position between the motor section and the pump section, and
2) a second position between the first part of the motor section and the second part of the motor section.

4. The fuel supply unit as claimed in claim 3, wherein a cover body is mounted to a wall of a mount opening of the fuel tank and constitutes a part of the fuel tank, and the cover body covers the mount opening and receives the motor section of the fuel pump in such a manner that the motor section is disposed sidewise.

5. The fuel supply unit as claimed in claim 4, wherein the cover body includes the motor housing bulkhead and a flange section which has an expanded diameter on an opening side of the motor housing bulkhead, and the motor housing bulkhead of the cover body is inserted into the mount opening, with the flange section mounted to an upper plate of the fuel tank.

6. The fuel supply unit as claimed in claim 5, wherein the motor housing bulkhead 22 is a based barrel including:

1) a barrel section having a cross section shaped substantially into a lying English alphabet D, and
2) a base section covering a lower side of the barrel section, and the barrel section is formed with a concave barrel section which is concaved sidewise and has a base.

7. The fuel supply unit as claimed in claim 6, wherein in the motor housing bulkhead, the motor section of the fuel pump and a female joint of a magnet joint are disposed sidewise, in a position along an axial line of the concave barrel section, around the motor section in the motor housing bulkhead, an electric part including a control unit for controlling the fuel pump, and a sensing section of a fuel gauge are provided, and inside the concave barrel section and thereby outside the motor housing bulkhead, a rotatable male joint of the magnet joint is provided.

8. The fuel supply unit as claimed in claim 7, wherein the concave barrel section of the motor housing bulkhead has an outer periphery formed with an outer magnet of the female joint constituting the magnet joint, and has an inner periphery formed with an inner magnet of the male joint, and the concave barrel section substantially radially overlaps the outer magnet of the female joint with the inner magnet of the male joint, thus keeping the sealed separation of the motor section from the fuel and encouraging a magnetic coupling.

9. The fuel supply unit as claimed in claim 8, wherein the motor section includes a motor case, a stator fixed on an inner periphery of the motor case, a rotor rotatably disposed inside the stator, a pair of brushes for energizing the rotor, and an output shaft disposed on a rotation center of the rotor in such a manner as to rotate substantially integrally with the rotor, and the output shaft has a first end protruding outward from the motor case.

10. The fuel supply unit as claimed in claim 9, wherein a heat insulation space as a heat insulating means is defined between the barrel section of the motor housing bulkhead and the motor case of the motor section, and the heat insulation space insulates the heat from being conveyed to the fuel in the fuel tank.

11. The fuel supply unit as claimed in claim 10, wherein substantially coaxially with the motor section, the pump section is disposed outside the motor housing bulkhead, the pump section includes a pump case, an inner housing cased in the pump case, an outer housing, an annular housing sandwiched between the inner housing and the outer housing, a shaft section, and a turbine vane, the pump case shaped substantially into a barrel is fixed to an outer periphery of the barrel section, the shaft section has: a first side fixed in substantially a center section of both of the inner housing and the outer housing, and a second side extending into the concave barrel section of the motor housing bulkhead, and the turbine vane is sandwiched between the inner housing and the outer housing, and is rotatably disposed around an outer periphery of the shaft section.

12. The fuel supply unit as claimed in claim 11, wherein between the motor section and the pump section, the magnet joint is disposed, and the magnet joint conveys the rotational speed of the motor section to the pump section, with the concave barrel section of the motor housing bulkhead free from a contact with the female joint and the male joint which two members constituting the magnet joint.

13. The fuel supply unit as claimed in claim 12, wherein the female joint of the magnet joint is disposed in the motor housing bulkhead and is rotatable by means of the motor section, the male joint of the magnet joint is disposed outside the motor housing bulkhead, and being interlocked with the female joint, the male joint drives the pump section.

14. The fuel supply unit as claimed in claim 13, wherein the female joint of the magnet joint includes a magnet mounting barrel and a plurality of the outer magnets, the magnet mounting barrel shaped substantially into a covered barrel surrounds the concave barrel section of the motor housing bulkhead, on an inner periphery of the magnet mounting barrel, the outer magnet having an S pole and the outer magnet having an N pole are alternately disposed circumferentially, and the magnet mounting barrel is mounted to the output shaft of the motor section.

15. The fuel supply unit as claimed in claim 14, wherein the male joint of the magnet joint includes a hollow magnet mounting shaft and a plurality of the inner magnets, the magnet mounting shaft is disposed inside the concave barrel section of the motor housing bulkhead and is rotatably supported by the shaft section of the pump section, on an outer periphery of the magnet mounting shaft, the inner magnet having an S pole and the inner magnet having an N pole are alternately disposed circumferentially, and the magnet mounting shaft is connected to the turbine vane by way of an engagement protrusion extending toward the pump section.

16. The fuel supply unit as claimed in claim 15, wherein the outer magnet of the female joint and the inner magnet of the male magnet sandwiching therebetween the concave barrel section of the motor housing bulkhead magnetically attract each other, thus rotating the female joint together with the male joint, and when the motor section in the motor housing bulkhead is driven, the magnet joint rotates the pump section with the concave barrel section sandwiched, free of the contact, between the outer magnet and the inner magnet.

17. The fuel supply unit as claimed in claim 3, wherein a cover body is mounted to a wall of a mount opening of the fuel tank and constitutes a part of the fuel tank, the cover body receives the motor section of the fuel pump in such a manner that the motor section is disposed lengthwise substantially perpendicular to sidewise, and the cover body is shaped substantially into a stepped barrel.

18. The fuel supply unit as claimed in claim 17, wherein the cover body includes the motor housing bulkhead, an electric part housing and a flange section, the motor housing bulkhead extending substantially axially in substantially an upward- and downward direction has a deep base and shaped substantially into a based barrel, the electric part housing formed by increasing in diameter an opening side of the motor housing bulkhead has a shallower base than the motor housing bulkhead, and the flange section is formed by increasing in diameter an opening side of the electric part housing.

19. The fuel supply unit as claimed in claim 18, wherein the motor housing bulkhead constitutes a sealing means for sealably separating the motor section from the fuel in fuel tank, thus bringing about the oil tightness, the motor housing bulkhead shaped substantially into a based barrel includes a barrel section, a base section and a concave barrel section, the barrel section extends upward and downward, the base section disposed below the barrel section is shaped substantially into an annulus, the concave base section is a based barrel which is bent from an inner periphery of the base section into the barrel section, and the concave base section is substantially coaxial with the barrel section.

20. The fuel supply unit as claimed in claim 3, wherein the motor housing bulkhead constituting a sealing means includes a barrel section, a base section and a concave barrel section, thus forming a based barrel extending substantially axially, the concave barrel section inroads into the barrel section, and substantially an innermost base of the concave barrel section is formed with a bearing barrel section.

21. The fuel supply unit as claimed in claim 20, wherein the motor section constituting the fuel pump includes a stator and an inner rotor, the stator housed in the motor housing bulkhead and sandwiched between the barrel section and the concave barrel section constitutes the first part of the motor section, while the inner rotor disposed outside the motor housing and therefore inside the concave barrel section constitutes the second part of the motor section, the inner rotor is rotatably born by a bearing shaft 86 having a first end mounted to the bearing barrel section of the motor housing bulkhead and a second end mounted to an outer housing of the pump section, and an engagement protrusion constituting the second part of the motor section engages with a turbine vane of the pump section in such a manner as to rotate substantially integrally with the turbine vane.

22. The fuel supply unit as claimed in claim 3, wherein the motor housing bulkhead including a barrel section and a base section is formed into a based barrel, the base section blocks a lower side of the barrel section, and substantially in a center of base section, a concave barrel section is formed.

23. The fuel supply unit as claimed in claim 22, wherein the motor section which constitutes the fuel pump includes a stator and an outer rotor, the stator housed in the barrel section of the motor housing bulkhead constitutes the first part of the motor section, while the outer rotor disposed outside barrel section of the motor housing bulkhead constitutes the second part of the motor section, the outer rotor covering the barrel section is shaped substantially into a based barrel, and the outer rotor has a base section which is rotatably born by a bearing shaft and which engages with a turbine vane of the pump section by way of an engagement protrusion which constitutes the second part of the motor section.

24. The fuel supply unit as claimed in claim 23, wherein a barrel cover covers an outer periphery of the outer rotor, and the barrel cover has a head end side formed with a pump case.

25. The fuel supply unit as claimed in claim 1, wherein a base section of a chamber constitute a part of a base plate of the fuel tank.

26. The fuel supply unit as claimed in claim 1, wherein a part of an upper plate of the fuel tank is so machined as to be dent downward for providing a space for the motor housing bulkhead.

27. The fuel supply unit as claimed in claim 1, wherein the fuel supply unit includes any one of:

a heat insulation space occupied by an insulation material, and the motor housing bulkhead made of an insulation material.

28. The fuel supply unit as claimed in claim 1, wherein the fuel supply unit includes any one of:

a trochoid, a gear, and, a reciprocating member.

* * * * *